US008466793B2

(12) United States Patent
Kolton et al.

(10) Patent No.: US 8,466,793 B2
(45) **Date of Patent: *Jun. 18, 2013**

(54) ELECTRONIC TAG HOLDER FOR BOTTLE NECK

(75) Inventors: Chester Kolton, Westfield, NJ (US); Michael Norman, East Brunswick, NJ (US); Alex Tetiyevsky, Springfield, NJ (US)

(73) Assignee: B&G Plastics, Inc., Newark, NJ (US)

( * ) Notice: Subject to any disclaimer, the term of this patent is extended or adjusted under 35 U.S.C. 154(b) by 315 days.

This patent is subject to a terminal disclaimer.

(21) Appl. No.: 12/787,889

(22) Filed: May 26, 2010

(65) Prior Publication Data

US 2011/0074583 A1 Mar. 31, 2011

Related U.S. Application Data

(63) Continuation-in-part of application No. 12/566,807, filed on Sep. 25, 2009.

(60) Provisional application No. 61/102,532, filed on Oct. 3, 2008.

(51) Int. Cl.
*G08B 13/14* (2006.01)

(52) U.S. Cl.
USPC ..... 340/572.8; 340/572.1; 340/10.1

(58) Field of Classification Search
USPC ..... 340/572.1, 10.1, 505
See application file for complete search history.

(56) References Cited

U.S. PATENT DOCUMENTS

| | | | | |
|---|---|---|---|---|
| 3,685,676 | A | 8/1972 | Gach et al. | |
| 3,756,444 | A | 9/1973 | McIntosh | |
| 3,853,236 | A | 12/1974 | Ostrowsky | |
| 3,902,339 | A | 9/1975 | Carley et al. | |
| 3,915,326 | A | 10/1975 | Hrubesky | |
| 4,018,640 | A * | 4/1977 | Amberg | 156/86 |
| 4,089,463 | A | 5/1978 | Babiol | |
| 4,176,756 | A | 12/1979 | Gellman | |
| 4,405,161 | A | 9/1983 | Young et al. | |
| 4,457,445 | A | 7/1984 | Hanks et al. | |
| 4,471,982 | A | 9/1984 | Nielsen, Jr. | |
| 4,674,778 | A | 6/1987 | Ruiz | |
| 4,729,487 | A | 3/1988 | Wright | |
| 4,813,564 | A | 3/1989 | Cooper et al. | |
| 5,230,541 | A | 7/1993 | Nowak | |
| 5,602,530 | A | 2/1997 | Holmgren | |
| 5,667,085 | A | 9/1997 | Ogden et al. | |
| 6,137,413 | A | 10/2000 | Ryan, Jr. | |
| 6,254,139 | B1 | 7/2001 | Fresnel | |

(Continued)

FOREIGN PATENT DOCUMENTS

| | | | |
|---|---|---|---|
| GB | 2465892 | A | 6/2010 |
| WO | 2007/086984 | A1 | 8/2007 |
| WO | 2008/075310 | | 6/2008 |

*Primary Examiner* — Travis Hunnings
(74) *Attorney, Agent, or Firm* — Hoffman & Baron, LLP

(57) ABSTRACT

A device supports an electronic tag to extending neck of a bottle where the extending neck includes a perimetrical undercut thereabout. The device includes a housing formed of a pair of matable housing portions for attachment about the neck of the bottle. At least one of the housing portions supports an electronic tag. A rim portion is formed on each housing portion. The rim portions are mutually aligned. The rim portions form a housing rim which is seatable in the undercut of the neck to prevent longitudinal movement of the mated housing portions along the neck.

18 Claims, 6 Drawing Sheets

U.S. PATENT DOCUMENTS

| | | | | |
|---|---|---|---|---|
| 6,342,838 | B1 | 1/2002 | Kolton et al. | |
| 6,604,643 | B1 * | 8/2003 | Michael et al. | 215/204 |
| 6,696,955 | B2 | 2/2004 | Kolton et al. | |
| 6,831,552 | B2 | 12/2004 | Lin | |
| D506,694 | S | 6/2005 | Corney | |
| 7,048,179 | B2 | 5/2006 | Claessens et al. | |
| 7,061,382 | B2 | 6/2006 | Claessens et al. | |
| 7,394,383 | B2 | 7/2008 | Hager et al. | |
| 7,804,405 | B2 * | 9/2010 | Norman et al. | 340/572.1 |
| 2006/0151414 | A1 | 7/2006 | Mullen | |
| 2007/0062903 | A1 * | 3/2007 | Norman et al. | 215/274 |
| 2007/0285243 | A1 | 12/2007 | Feibelman | |
| 2008/0030334 | A1 * | 2/2008 | Marsilio et al. | 340/572.1 |
| 2008/0048868 | A1 | 2/2008 | Chua et al. | |
| 2008/0230509 | A1 | 9/2008 | Koo et al. | |
| 2008/0289372 | A1 | 11/2008 | Rendon et al. | |
| 2010/0085191 | A1 * | 4/2010 | Kolton et al. | 340/572.8 |
| 2010/0133224 | A1 * | 6/2010 | Kolton et al. | 215/40 |
| 2010/0253524 | A1 * | 10/2010 | Kolton et al. | 340/572.9 |

* cited by examiner

ELECTRONIC TAG HOLDER FOR BOTTLE NECK

CROSS-REFERENCE TO RELATED APPLICATION

This application claims priority to U.S. patent application Ser. No. 12/566,807, filed on Sep. 25, 2009, and U.S. Provisional Patent Application No. 61/102,532, filed on Oct. 3, 2008, which is incorporated herein by reference.

FIELD OF THE INVENTION

The present invention relates generally to a holder for an electronic tag. More particularly, the present invention relates to a holder for an electronic tag which may be applied to a bottle neck.

BACKGROUND OF THE INVENTION

Electronic tags are used for a wide variety of purposes, including the tracking of items which contain the tag, inventory control, security, and also provide information which may be electronically readable.

These tags or markers may include radio frequency identification (RFID) tags or electronic article surveillance (EAS) tags. EAS tags may be used to provide theft deterrence. These tags are used in combination with an alarm system which monitors undesired movement of the article containing the EAS tag.

Devices such as holders or housings for such tags have been developed which accommodate the electronic tag and which attach the tags to the desired article. It is desired that the tags be securely supported to the article in such a manner where it remains with the article until the time of purchase.

With respect to some articles, such as beverage bottles, various housings have been developed to secure the tag to different locations on the bottle. One troublesome location to apply tags is to the outside surface of the neck of the bottle. While this is a desirous location to apply the tag, it is difficult to retain the tag thereon, as the tag housing can normally be removed by sliding the housing up over the extending neck.

It is therefore desirable to provide a tag housing which may be secured to the outside surface of a bottle neck and can not be readily removed therefrom.

SUMMARY OF THE INVENTION

The present invention provides a device for supporting an electronic tag to an extending neck of the bottle where the bottle includes a perimetrical undercut thereabout. The device includes a housing formed of a pair of matable housing portions for attachment about the neck of the bottle, at least one of the housing portions providing support for the tag. A rim portion is formed on each of the housing portions. The rim portions of each housing portion are mutually aligned. The rim portions of the housing portions are seatable in the undercut of the neck to prevent longitudinal movement of the mated housing portions along the neck.

In one embodiment, the housing portions may be hermaphroditically configured.

Moreover, in a preferred embodiment, the housing is designed to engage an undercut formed in the bottle neck. However, the undercut may also consist of the bottom edge of a label placed on the neck of the bottle.

DETAILED DESCRIPTION OF THE INVENTION

The present invention provides a device for supporting electronic tag on the neck of a bottle.

Figure 1:
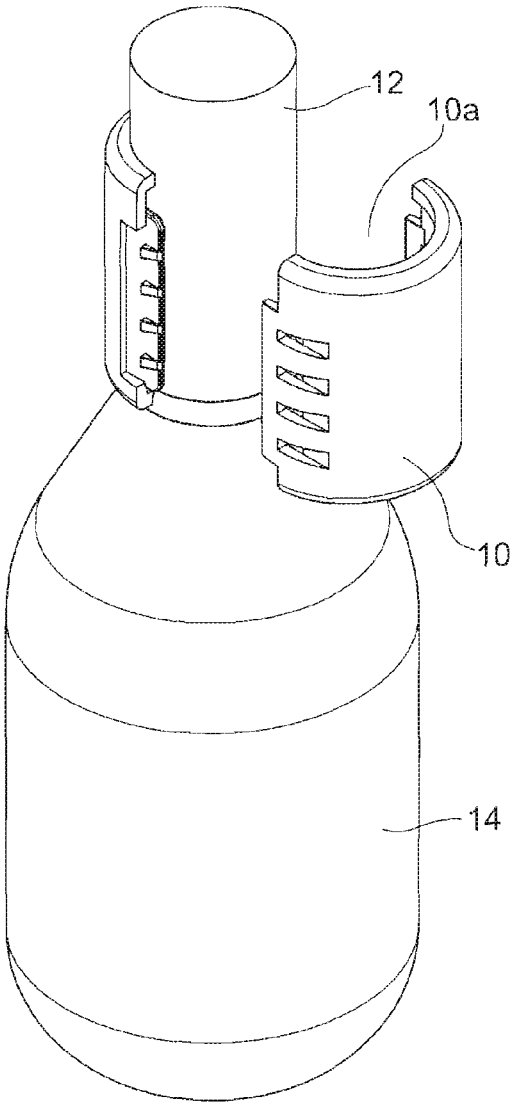
FIGS. 1 and 2 are perspective showings of the electronic tag housing of the present invention attachable to the neck of a bottle.
Figure 2:
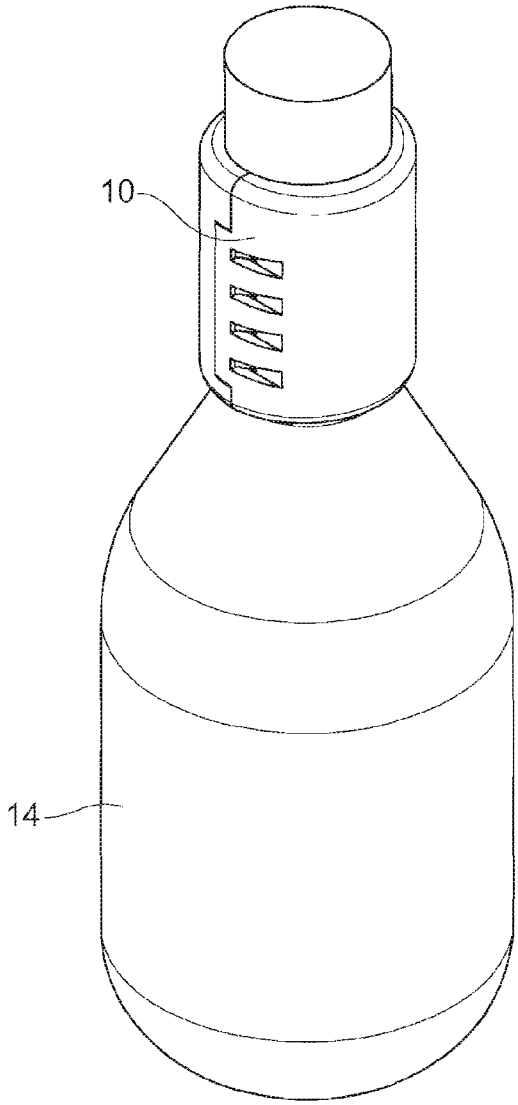

As shown in FIGS. 1 and 2, the device of the present invention includes a tag holder or housing 10 which is designed to be supported on the neck 12 of a bottle 14. The housing 10 supports an electronic tag 16 (FIG. 6) such as a radio frequency identification (RFID) tag, an electronic article security tag (EAS) tag or any similar electronic tag.

The present invention is designed to attach the tag 16 to the bottle 14 where the bottle includes a perimetrical undercut 20 which in this case is a circumferential undercut, in order to prevent the tag housing 10 from being removed from the neck of the bottle.

Figure 5:
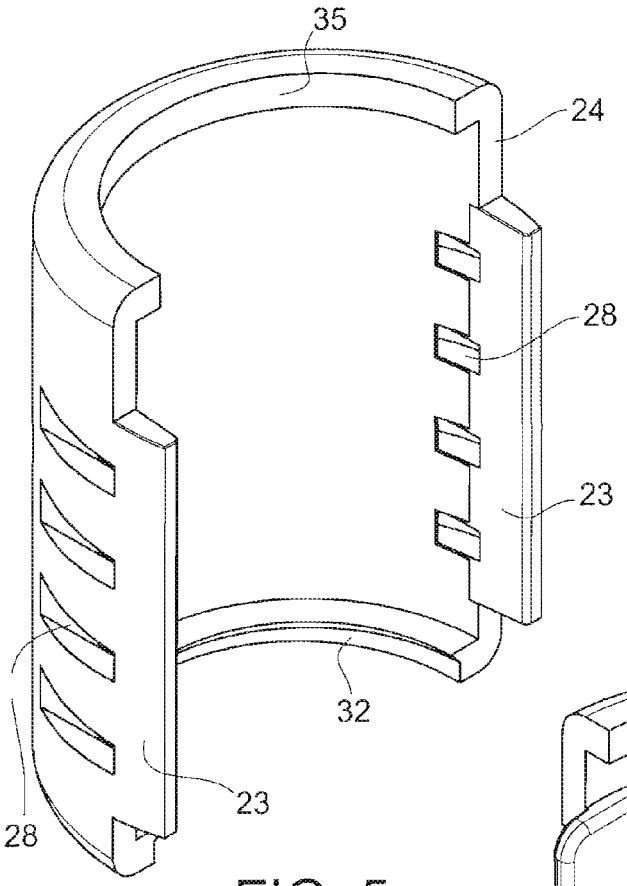
FIGS. 5 and 6 are perspective views of the housing portions forming the tag housing of the present invention.
Figure 6:
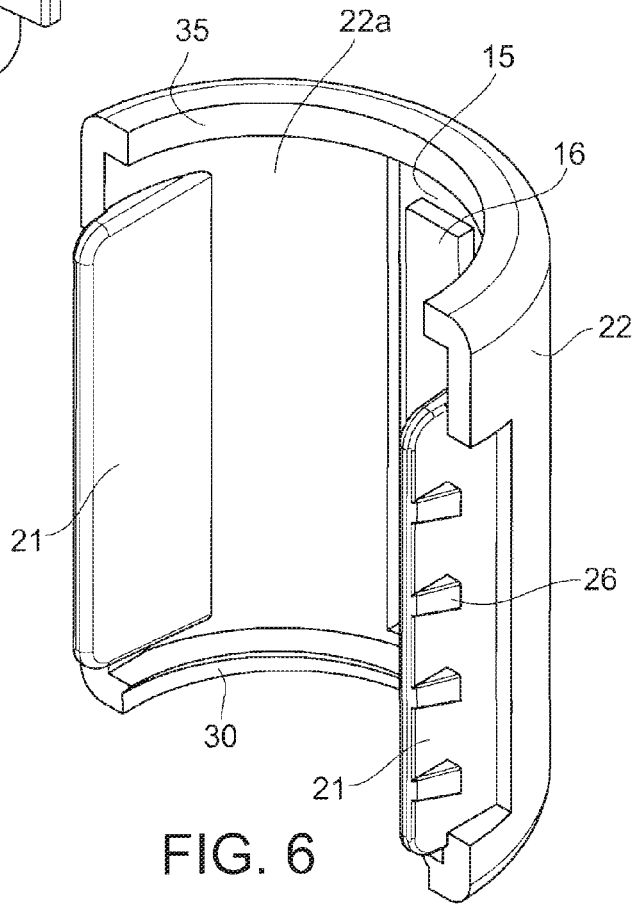

The housing 10 includes two semi-cylindrical housing halves or portions 22 and 24. One housing portion 22 is shown in FIG. 5, while the other housing portion 24 is shown in FIG. 6.

Figure 3:
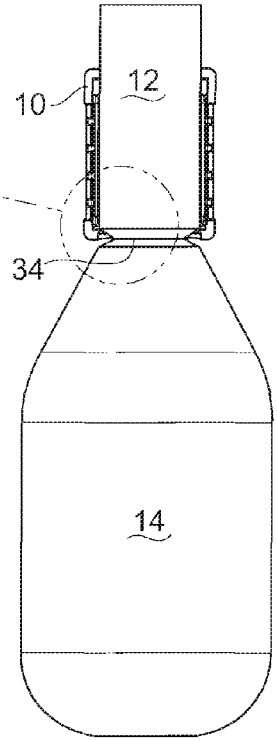
FIG. 3 is a plan view, partially in section, of the electronic tag housing of the present invention attached to the bottle neck.

As shown in FIGS. 2 and 3, the housing 10, when assembled, is generally a cylindrical body having a central bore 10*a* with a diameter which is designed to accommodate the extending neck 12 of bottle 14. The tag 16 may be secured to one of the housing portions 22 or 24. As shown in FIG. 6, one housing portion 22 may include a recessed portion 15 in the inner wall 22*a* thereof. The tag 16 may be secured to the inner wall 22*a* within the recessed portion 15. Any securement technique such as adhesive may be used to attach the tag 16 to the wall 22*a* of housing 22.

The housing portions 22 and 24 are interlockable to secure the mated housing about the neck 12 of bottle 14. The housing portions provide cooperative mating structures. As shown in detail in FIGS. 5 and 6, in order to provide such mating connection, housing portion 22 includes a pair of extending surfaces 21 at diametrically opposed locations. Each projecting surface 21 includes a row of vertically spaced projecting fingers 26. Similarly, housing portion 24 includes a pair of extending surfaces 23 at diametrically opposed locations. Each projecting surface 23 includes a row of vertically spaced slots 28 which receive the projecting fingers 26 when the housing portions are mated around the neck 12 of bottle 14. The fingers 26 are configured at an angle to permit one way insertion into slots 28.

While in the preferred embodiment, housing portions 22 and 24 include either fingers or slots for mutual engagement, it is contemplated that the housing portions could include both slots and fingers for mutual engagement. More specifically, the housing portions could be formed to be identical hermaphroditic components.

The housing portions 22 and 24 are constructed such that the configuration of the projections and the slots permit one way mating attachment. Detachment of the housing portions can not be readily achieved without damage to the housing 10. In this manner, the electronic tag 16 can not be removed without destructive disassembly of the housing.

As noted above, the present invention provides a tag housing 10 which is designed to be accommodated on a neck 12 of a bottle 14 where the neck includes a circumferential undercut. This circumferential undercut is used in combination with features of the housing to prevent the mated housing from being removed from the neck 12 by sliding the housing up over the neck.

Figure 4:
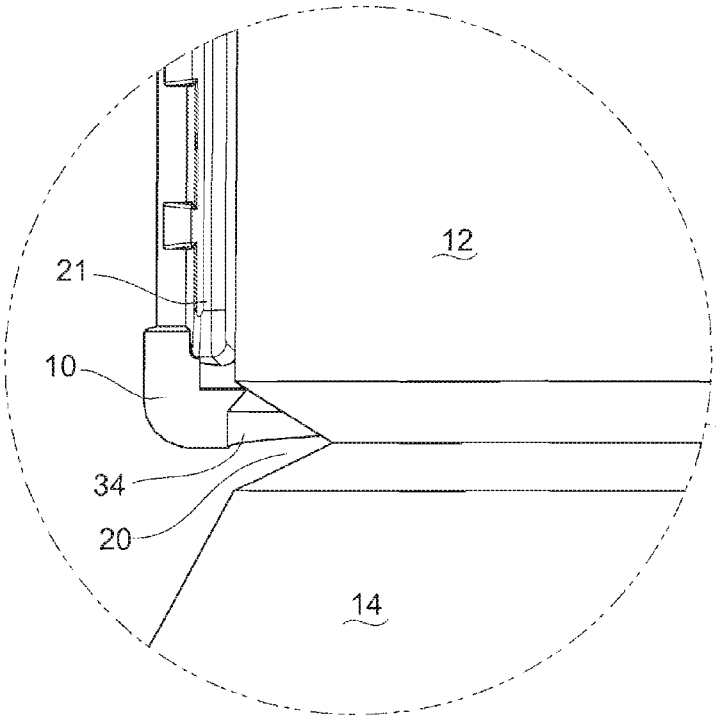
FIG. 4 is an enlarged sectional showing of the bottle neck showing the tag housing attached thereto.

As shown in FIGS. 5 and 6, each of housing portions 22 and 24 include, around the bottom edge thereof, inwardly projecting semi-circular rims 30 and 32, respectively. When assembled and as shown in FIGS. 3 and 4, the semi-circular rims 30 and 32 form a complete circumferential rim 34 which is inwardly directed and extends around the bottom edge of housing 10.

As the housing portions 22 and 24 are mated about the extended neck 12, the rim 34 formed by the two housing portions 22 and 24, seats within the circumferential undercut 20. Since the mated housing 10 can not be disassembled or otherwise enlarged, this seating of the rim 34 within undercut 20 prevents the housing 10 from sliding upward along the neck 12 of bottle 14. This prevents the unauthorized removal of housing 10 therefrom by sliding the housing up over the neck.

While the rim 34 is shown at the lower end of mated housing 10, it can also be provided at the upper end thereof, or for that matter, any location along the length of the housing 10. The upper end of housing 10 also includes an inwardly directed lip 35. The lip 35 closes the housing 10 preventing access to the tag 16 when the housing is mated about the neck 12. If the rim 34 is located at the upper end of the mated housing 10, the lip 35 is positioned at the lower end.

While the rim 34 is positioned so as to mate with the undercut 30 provided on the neck 14 of the bottle 16, it is also contemplated that the housing of the present invention may be applied to a bottle neck having an undercut formed by a label placed around the neck of the bottle.

Figure 7:
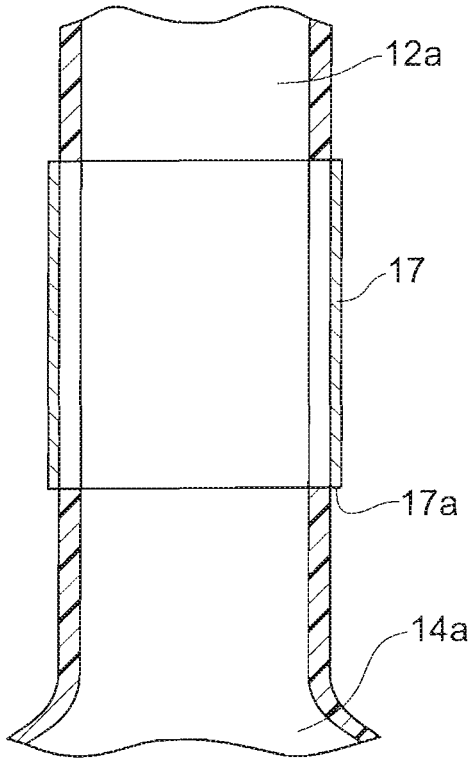
FIG. 7 shows a bottle neck of an alternative configuration to which the tag housing of the present invention may be attached.

With reference to FIG. 7, a neck 12*a* of bottle 14*a* has a label 17 wrapped therearound. The lower circumferential edge 17*a* of label 17 forms the undercut which may be accommodated by the rim 34 of housing 10 to prevent slidable removal therefrom.

Figure 8:
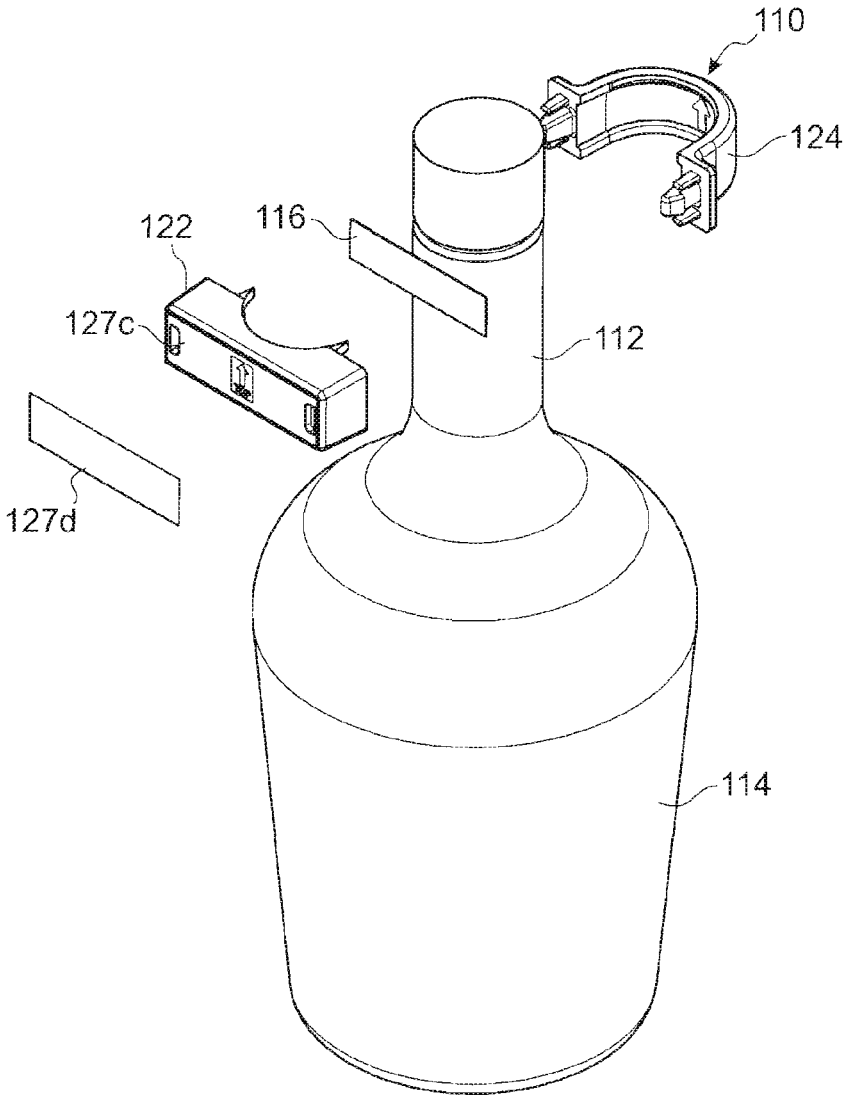
FIG. 8 is a perspective showing of a further embodiment of the electronic tag housing of the present invention attachable to a neck of a bottle.

Referring now to FIG. 8, a further embodiment of the tag housing of the present invention is shown. The tag housing 110 of the present embodiment is substantially similar to the housing 10 shown above. Accordingly, similar reference numerals will be used to denote similar structure.

The tag housing 110 is also designed to be supported on extending neck 112 of bottle 114. This embodiment of tag housing 110 includes a base housing 122 and a strap housing 124 which is attachable to the base housing 122 about elongate neck 112 of bottle 114.

Figure 9:
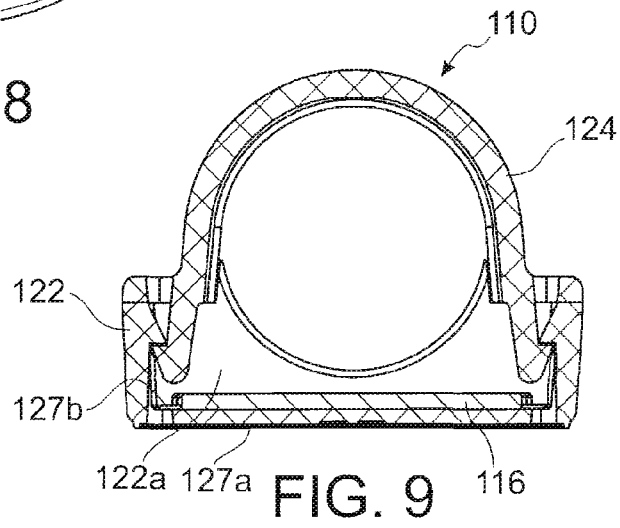
FIG. 9 is a cross-sectional showing of the assembled tag housing of FIG. 8.
Figure 10:
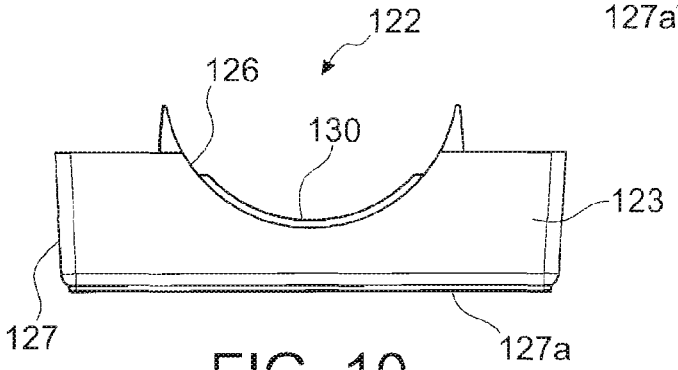
FIGS. 10 and 11 show respectively, plan and perspective views of the housing base of the present invention.
Figure 11:
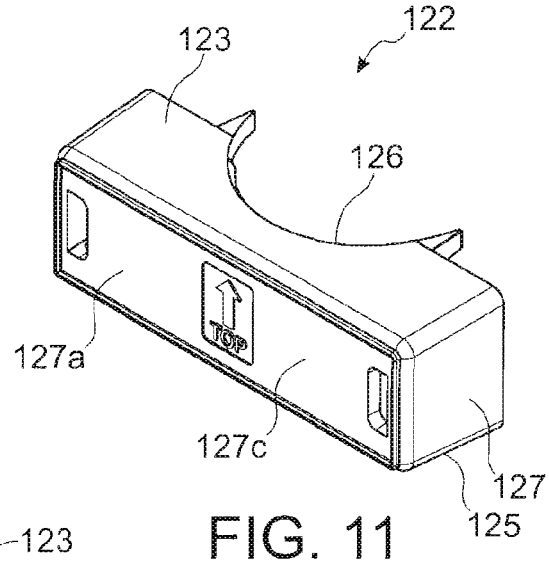

As shown in FIGS. 9-11, base housing 122 is designed to support an electronic tag 116 therein. Tag 116 may be secured in any conventional fashion within a cavity 122*a* of base housing 122. The base housing 122 includes upper and lower spaced apart planar surfaces 123 and 125 and a partial perimetrical wall 127 extending therebetween. The elongate end extent 127*a* of perimetrical wall 127 may be used to support tag 116 on an inner surface 127*b* thereof. The opposite outer surface 127*c* of elongate extent 127*a* may support a label 127*d* or the like (FIG. 8). The spaced apart planar surfaces 123 and 125 include arcuate cutouts which define a semi-circular neck engagement portion 126 for engagement with the neck 112 of bottle 114.

Figure 12:
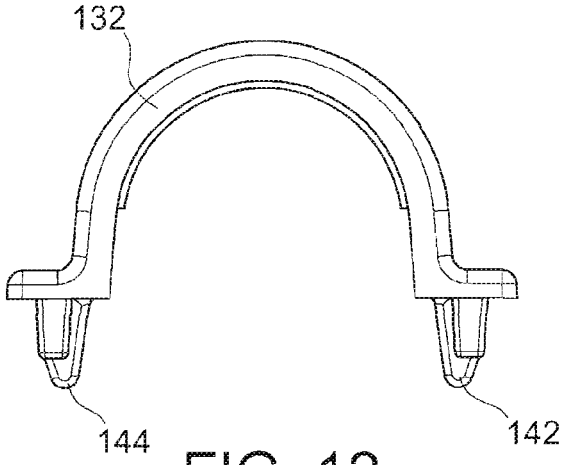
FIGS. 12 and 13 are plan and perspective showing of the housing strap of the present invention.
Figure 13:
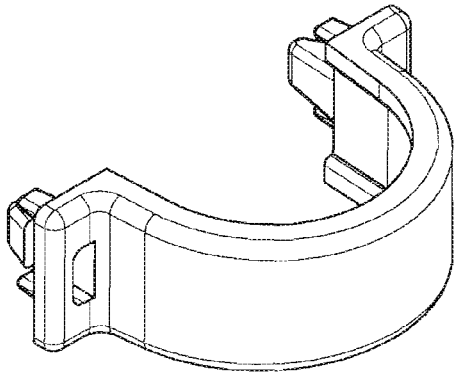

Referring now to FIGS. 9, 12 and 13, strap housing 124 is shown. Strap housing 124 is generally a U-shaped member having a semi-circular arcuate wall 140. A pair of extending latch arms 142 and 144 extend outwardly therefrom. The latch arms are deflectable so as to provide one-way snap fit accommodation within recesses 129 on wall 127*a* of base housing 122. Adjacent latch arms 142 and 144 are extending fingers 142*a* and 144*a* which serve as alignment posts aligning strap housing 124 with the base housing 122 to secure the housing 10 around the neck 112 of bottle 114.

As particularly shown in FIG. 10, upper planar surface 123 includes adjacent the arcuate cutout, an extending arcuate or semi-circular rim 130. Similarly, as shown in FIG. 12, strap housing 124 includes an arcuate or semi-circular rim 132 along an upper edge thereof. Similar to the embodiments shown above, when strap housing 124 is assembled to base housing 122, the circular rims 130 and 132 form a nearly complete circumferential rim which is inwardly directed and extending adjacent the top edge of housing 110. As the base housing 122 and strap housing 124 are mated about the extending neck 112, the rims 130 and 132 seat within a circumferential undercut 120 in the neck of bottle 112. Since the mated housing 110 cannot be disassembled or otherwise enlarged, the seating of the rims 130 and 132 within undercut 120 prevents the housing 110 from sliding along the neck 112 of bottle 114. This prevents unauthorized removal of the housing 110 by sliding the housing over the neck. While the rims 130 and 132 are shown to be positioned adjacent the top edge of the housing 110, they could also be located adjacent the bottom edge for a differently positioned undercut in neck 112.

Various changes to the foregoing described and shown structures would now be evident to those skilled in the art. Accordingly, the particularly disclosed scope of the invention is set forth in the following claims.

What is claimed is:

1. A device for supporting an electronic tag to an extending neck of a bottle, said device comprising:

a housing formed of a pair of mateable housing portions for attachment about said extending neck of said bottle, said housing portions forming a central bore permitting extension of said neck therethrough, at least one of said housing portions providing support for said tag;

a rim portion formed on each said housing portion, said rim portion of each said housing portion being mutually aligned to form a generally perimetrical rim;

said rim portions being engageable with said neck to prevent longitudinal movement of said mated housing portions along said neck.

2. A device of claim 1 wherein said housing portions include cooperative mating structure for attaching said pair of housing portions about said neck of said bottle.

3. A device of claim 2 wherein said cooperative mating structure prevents non-destructible detachment of said mating portions.

4. A device of claim 3 wherein said housing portions are semi-cylindrical, said mutually aligned edges forming a generally cylindrical configuration.

5. A device of claim 4 wherein said cooperative mating structure includes one said housing portions having fingers extending adjacent said opposed edges and the other said housing portions including slots adjacent said opposed edges, said fingers being insertable into said slots to secure said housing portions together.

6. A device of claim 2 wherein said housing portions are hermaphroditically formed.

7. A device of claim 1 wherein said at least one of said housing portions includes an internal wall for supporting said tag.

8. A device of claim 7 wherein said internal wall includes a receiving portion for accommodating said tag.

9. A device of claim 7 wherein said housing portions include an upper end and a lower end, said rim portion being formed on said lower end of said housing portions.

10. A device of claim 9 wherein said each housing portion further includes a lip formed adjacent said upper end thereof, said lip of each said housing portion being mutually aligned to form a perimetrical lip preventing access to said tag when said housing portions are mated.

11. A device of claim 1 wherein one said housing portions include a base housing and the other said housing portion includes a strap housing, said strap housing for coupling to said base housing.

12. A device of claim 11 wherein said tag is supported in the base housing.

13. A device of claim 11 wherein said base housing includes a pair of recesses therein and wherein said strap housing includes a pair of latches, said latches being insertable into said recesses preventing non-destructible removal of said latches therefrom.

14. A device of claim 11 wherein said base housing and said strap housing include said rim portions which are aligned upon said coupling said base housing to said strap housing.

15. A device of claim 14 wherein said base housing and said strap housing include an upper end and wherein said rim portions are formed adjacent the upper ends thereof.

16. A device of claim 1 wherein said extending neck of said bottle has a perimetrical undercut therearound and wherein said rim portions are seatable in said undercut of said neck to prevent said longitudinal movement of said mating housing portions along said neck.

17. A device of claim 16 wherein said undercut is formed in said neck of said bottle.

18. A device of claim 16 wherein said neck of said bottle includes a label arranged therearound and wherein said undercut includes a lower edge of said label.

* * * * *